US010315839B2

(12) United States Patent
Kondoh

(10) Patent No.: US 10,315,839 B2
(45) Date of Patent: Jun. 11, 2019

(54) SHIPPING CONTAINER

(71) Applicant: JAPAN-CHINA EAST NORTH PRODUCTS CO., LTD., Tottori (JP)

(72) Inventor: Kenichi Kondoh, Tottori (JP)

(73) Assignee: JAPAN-CHINA EAST NORTH PRODUCTS CO., LTD., Tottori (JP)

( * ) Notice: Subject to any disclaimer, the term of this patent is extended or adjusted under 35 U.S.C. 154(b) by 0 days.

(21) Appl. No.: 15/552,393

(22) PCT Filed: Jun. 15, 2016

(86) PCT No.: PCT/JP2016/067720
§ 371 (c)(1),
(2) Date: Aug. 21, 2017

(87) PCT Pub. No.: WO2016/204156
PCT Pub. Date: Dec. 22, 2016

(65) Prior Publication Data

US 2018/0037403 A1 Feb. 8, 2018

(30) Foreign Application Priority Data

Jun. 15, 2015 (JP) ..... 2015-119903

(51) Int. Cl.
*E06C 1/34* (2006.01)
*B65D 88/10* (2006.01)
(Continued)

(52) U.S. Cl.
CPC ..... *B65D 88/10* (2013.01); *B65D 88/528* (2013.01); *B65D 90/006* (2013.01); *B65D 90/08* (2013.01);
(Continued)

(58) Field of Classification Search
CPC ..... B65D 88/00; B65D 88/02; B65D 88/027; B65D 88/10; B65D 88/12; B65D 88/121;
(Continued)

(56) References Cited

U.S. PATENT DOCUMENTS 4,797,049 A * 1/1989 Gearin ..... B60P 3/07 410/16
4,848,619 A * 7/1989 Corompt ..... B65D 88/121 220/1.5
(Continued)

FOREIGN PATENT DOCUMENTS

CA 2 667 746 11/2010
JP 56-138036 3/1980
(Continued)

OTHER PUBLICATIONS

International Preliminary Report on Patentability dated Dec. 19, 2017 in International (PCT) Application No. PCT/JP2016/067720.
(Continued)

*Primary Examiner* — Steven A. Reynolds
*Assistant Examiner* — Javier A Pagan
(74) *Attorney, Agent, or Firm* — Wenderoth, Lind & Ponack, L.L.P.

(57) ABSTRACT

A shipping container includes: a bottom plate onto which cargo is to be placed, columns vertically extending from the bottom plate, and top plates detachably supported by the columns. Since the top plates are detachable from the columns, it is possible to smoothly load long objects into the shipping container from above the container, by removing the top plates in advance. When the loading is completed, the top plates are attached back to the columns again to reinforce the columns, thereby ensuring the strength of the shipping container as a whole. A plurality of these shipping containers can therefore be stacked one on another in a
(Continued)

container ship, in the same manner as ordinary shipping containers.

8 Claims, 8 Drawing Sheets

(51) Int. Cl.
*B65D 90/08* (2006.01)
*B65D 88/52* (2006.01)
*B65D 90/00* (2006.01)

(52) U.S. Cl.
CPC ..... *E06C 1/34* (2013.01); *B65D 2590/0058* (2013.01)

(58) Field of Classification Search
CPC .. B65D 88/122; B65D 88/124; B65D 88/123; B65D 88/126; E06C 1/34
See application file for complete search history.

(56) References Cited

U.S. PATENT DOCUMENTS 5,141,122 A * 8/1992 Grogan ..... B65D 88/022 220/1.5
5,403,062 A * 4/1995 Sjostedt ..... B62D 33/046 220/1.5
5,678,715 A * 10/1997 Sjostedt ..... B65D 88/121 220/1.5
6,202,863 B1 * 3/2001 Grenier ..... B65D 88/123 211/70.4
6,739,468 B1 * 5/2004 Colebrook ..... B65D 88/121 220/1.5
9,868,589 B2 * 1/2018 Disorbo ..... B65D 88/12
2003/0175089 A1 * 9/2003 Almind ..... B65D 88/005 410/2
2007/0000921 A1 * 1/2007 Butler ..... B65D 88/121 220/1.5
2008/0105676 A1 * 5/2008 Park ..... B65D 88/121 220/1.5
2010/0025397 A1 * 2/2010 Krohn ..... B65D 88/12 220/6
2010/0025398 A1 * 2/2010 Krohn ..... B65D 88/12 220/7
2010/0025407 A1 * 2/2010 Benson ..... B65D 88/022 220/564
2010/0147842 A1 * 6/2010 Reynard ..... B65D 88/022 220/23.88
2010/0178126 A1 * 7/2010 Ness ..... B65D 88/123 410/31
2012/0255957 A1 * 10/2012 McGowen ..... B60P 3/24 220/564
2013/0062897 A1 * 3/2013 Olivier ..... B65D 88/123 294/68.1
2014/0175090 A1 * 6/2014 Bellehumeur ..... B65D 88/524 220/1.5
2015/0014886 A1 * 1/2015 Mullaney ..... E04B 1/3431 264/299
2015/0322642 A1 * 11/2015 Wu ..... E02B 17/025 405/8
2015/0344222 A1 * 12/2015 Disorbo ..... B60P 1/52 414/809
2015/0367988 A1 * 12/2015 Stanek ..... B65D 21/0224 29/428
2016/0137404 A1 * 5/2016 Steiner ..... B60P 1/28 220/1.5
2017/0021998 A1 * 1/2017 Flint ..... B65D 88/52
2017/0137210 A1 * 5/2017 Kamata ..... B65D 85/68

FOREIGN PATENT DOCUMENTS

JP 57-204884 12/1982
JP 11-60187 3/1999
JP 2015-696 1/2015

OTHER PUBLICATIONS

International Search Report dated Aug. 23, 2016 in International (PCT) Application No. PCT/JP2016/067720.

* cited by examiner

SHIPPING CONTAINER

TECHNICAL FIELD

The present invention relates to a shipping container for transporting cargo. More particularly, the present invention relates to a shipping container suitable for loading long objects such as lumber.

BACKGROUND ART

When transporting cargo in a shipping container, loading and unloading of the cargo into and out of the shipping container is carried out, as shown in JP 11-60187 A for example, through the opening formed by opening doors at the rear end of the shipping container (see FIG. 1 of JP 11-60187 A). In this case, a transport vehicle such as a forklift is used for the loading and unloading of the cargo. However, when transporting long objects such as lumber or steel materials, as cargo, there is a problem that a bundle of a plurality of such long objects may break during the loading and unloading thereof, and the end portions of the scattered long objects may come into contact with the inner surfaces of the shipping container, to cause damage to the inner surfaces or to the long objects themselves. In addition, loading and unloading of a large number of long objects into and out of the shipping container through the doors is a complicated operation, which consumes time and cost.

In view of this, it has been proposed to install a cargo bed for long objects to a transportation vehicle, as shown in JP 2015-696 A, for carrying out the transportation of long objects. This cargo bed includes a plurality of fall prevention columns vertically extending from both the right and left sides of its floor surface, at positions bilaterally symmetrical to each other (See e.g., FIG. 1 of JP 2015-696 A). The fall prevention columns serve to prevent the falling of the long objects loaded on the floor surface from the right and left sides of the floor surface. Since no top plate is provided on top of the fall prevention columns, the loading of the long objects can be carried out directly from above the cargo bed (see FIG. 6 in JP 2015-696 A).

However, the cargo bed for long objects disclosed in JP 2015-696 A is for use in a transportation vehicle such as a truck, and thus, in order to load long objects loaded on the cargo bed for long objects, into a container ship, it is necessary to unload the long objects from the cargo bed and to reload them into a shipping container. This reloading operation is extremely complicated, and causes an increase in the cost as a result thereof. In addition, there is a potential risk for other problems such as the occurrence of damage in the long objects during the reloading.

SUMMARY OF THE INVENTION

Accordingly, an object of the present invention is to provide a shipping container into which long objects such as lumber can be efficiently loaded.

In order to solve the above mentioned problems, the present invention relates to a shipping container including: a bottom plate onto which cargo is to be placed; columns vertically extending from the bottom plate; and a top plate detachably supported by the columns.

Since the top plate in this shipping container is detachable from the columns, it is possible to smoothly load cargo from above the shipping container by detaching and removing the top plate when loading the cargo into the shipping container. When the loading is completed, the top plate is attached back to the columns again. By attaching the top plate to the columns, the columns, which are separately and vertically disposed, are integrally joined together by the top plate, thereby ensuring the strength of the shipping container as a whole. Therefore, a plurality of such shipping containers can be stacked one on top of another in a container ship, in the same manner as ordinary shipping containers.

Preferably, the top plate of this shipping container is formed with one or more than one insertion recess into which a jig or jigs used to attach and detach the top plate to and from the columns are inserted. By forming such insertion recess or recesses in the top plate, a jig or jigs (such as forks of a forklift) can be inserted into the insertion recess or recesses, to allow for easily attaching and detaching the top plate.

In each of the above-described constitutions, at least one of the plurality of columns, which support the top plate, may be in the shape of a ladder. Such a ladder-shaped column allows an operator to climb up this ladder-shaped column to the upper portion of the shipping container, and to confirm the state of the loaded cargo. All of the columns need not be in the shape of a ladder. For example, the columns disposed at three locations on each side, namely at the foremost portion, central portion, and rearmost portion on each side of the shipping container may be in the shape of a ladder.

Effect of the Invention

In the constitution according to the present invention, the shipping container includes: a bottom plate onto which cargo is to be placed; columns vertically extending from the bottom plate; and a top plate detachably supported by the columns. Since the top plate of this shipping container is detachable from the columns, it is possible to smoothly load cargo from above the shipping container, by detaching and removing the top plate when loading the cargo into the shipping container. When the loading is completed, the top plate is attached back to the columns again. By attaching the top plate to the columns, the columns, which are separately and vertically disposed, are integrally joined together by the top plate, thereby ensuring the strength of the shipping container as a whole. Therefore, a plurality of such shipping containers can be stacked one on top of another in a container ship, in the same manner as ordinary shipping containers.

BRIEF DESCRIPTION OF THE DRAWINGS

FIG. 4 (*b*) shows an unlocked state thereof.

FIG. 6 (*b*) shows a state in which the column and the top plate are unlocked from each other; and FIG. 6 (*c*) shows a state in which the column and the top plate are locked together.

DETAILED DESCRIPTION OF THE INVENTION

Figure 1:
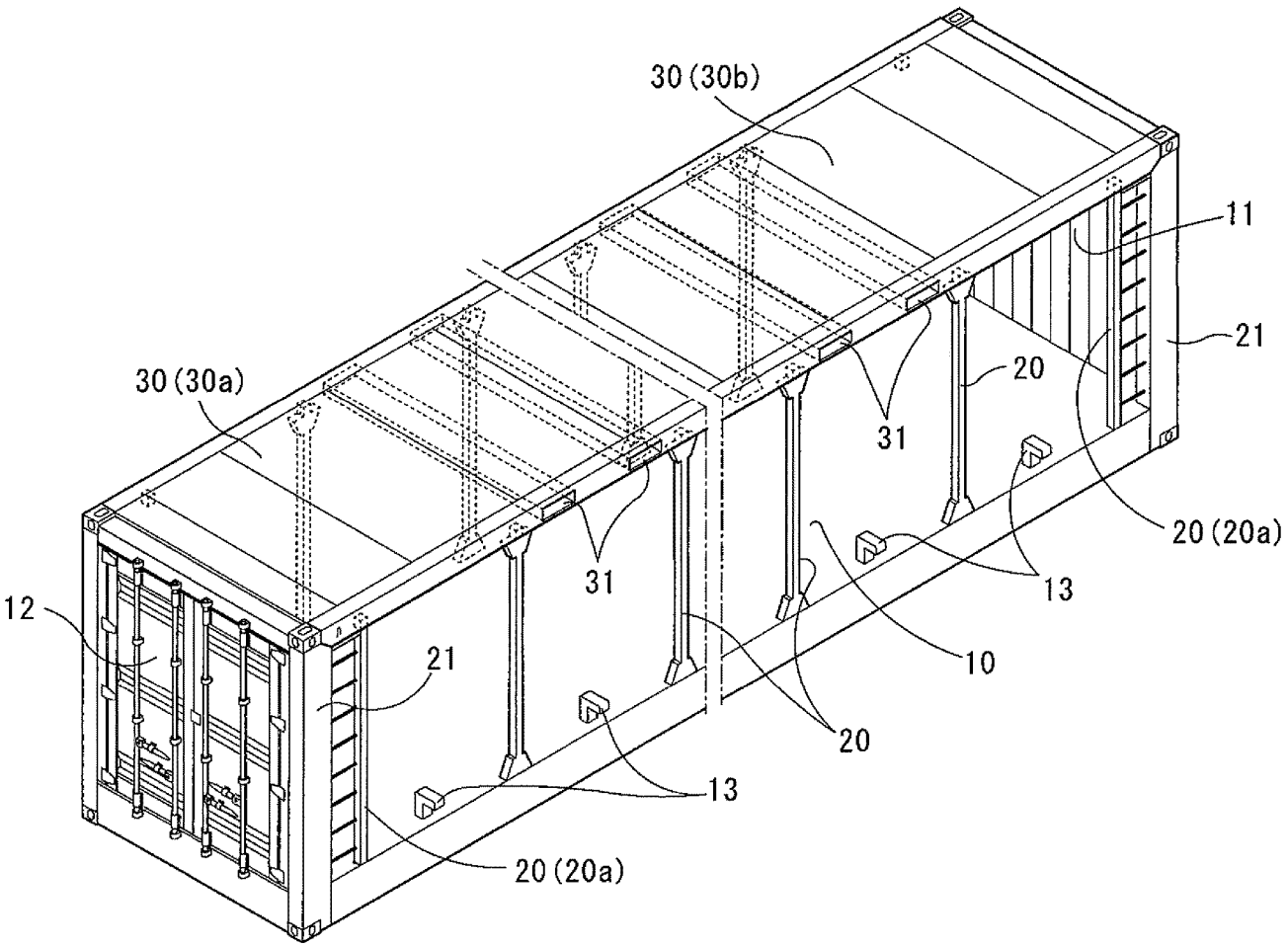
FIG. 1 is a perspective view of one embodiment of a shipping container according to the present invention.
Figure 2:
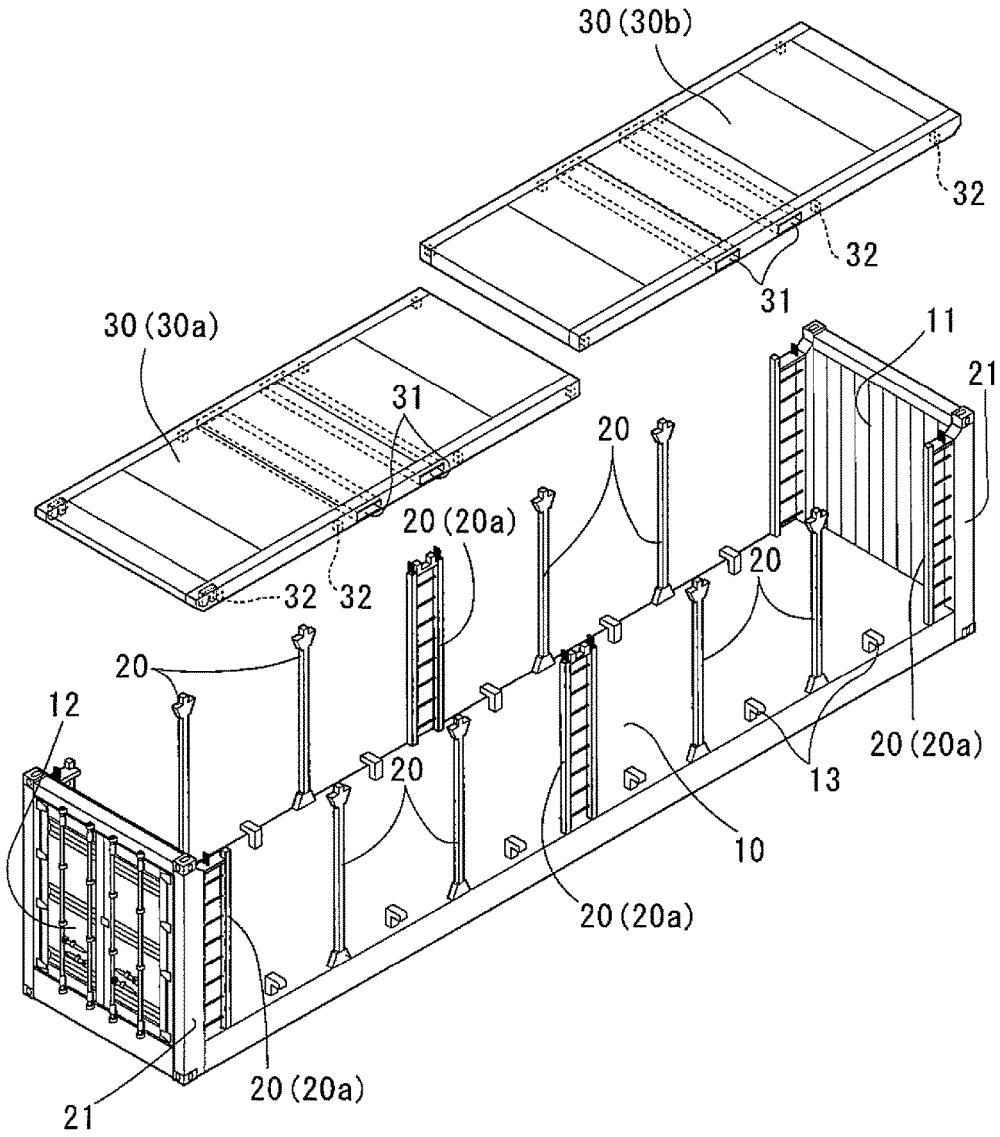
FIG. 2 is a perspective view of the shipping container shown in FIG. 1, in a state in which its top plates are removed.

One embodiment of a shipping container according to the present invention is shown in FIG. 1 and FIG. 2. This shipping container includes, as main components, a bottom plate 10, columns 20, and top plates 30. Unlike an ordinary shipping container, this shipping container does not have side plates, and cargo C loaded within the shipping container can be seen through the openings between the columns 20 (see FIG. 7).

The bottom plate 10 is a plate member in the shape of a rectangle, on top of which the cargo C is to be placed. The size of a shipping container is defined by international standards, and the bottom plate 10 is generally 20 feet or 40 feet long, and 8 feet wide, in accordance with the size defined in the international standards. A front plate 11 extends vertically from the front edge of the bottom plate 10, doors 12, which can be opened and closed extend vertically from the rear edge of the bottom plate 10. Fixing jigs 13 are provided on both the right and left sides of the upper surface of the bottom plate 10, spaced apart from each other at predetermined intervals (for example, at 1 m intervals).

The columns 20 consist of 14 vertically extending columns, seven of which are disposed on each of the right and left sides of the bottom plate 10. Of the seven columns 20 on each side of the bottom plate 10, the columns 20 (20*a*) disposed at the foremost portion, the central portion, and the rearmost portion of the bottom plate 10 are in the shape of a ladder. With this arrangement, an operator can easily check how the cargo C is loaded in the shipping container by climbing up one of the ladder-shaped columns 20 to the upper portion of the shipping container. Further, since the widths (lengths in the fore and aft direction) of the ladder-shaped columns 20 are usually larger than the widths of the other regular-shaped columns 20, it is possible to more stably hold the cargo C in the shipping container. The lengths of the columns 20 are usually adjusted such that the height of the shipping container (with the top plates 30 being attached) is 8 feet and 6 inches.

The number of the columns 20 is not limited, and may be varied taking into consideration the weight of the top plates 30, the required strength of the shipping container, and the like. The intervals between the adjacent pairs of columns 20 are preferably adjusted wider than the distance between the outer edges of the pair of forks of a commonly used forklift so that the cargo C can be easily loaded into the shipping container through its side, using a forklift. The columns 20 are preferably detachably attached to the bottom plate 10 so that the cargo C can be more easily loaded into the shipping container.

Engaging walls 21 are provided, respectively, at the front sides of the columns 20 (20*a*) disposed at the foremost portion of the shipping container (namely between the front plate 11 and the foremost columns 20 (20*a*)), and at the rear sides of the columns 20 (20*a*) disposed at the rearmost portion of the shipping container (namely between the doors 12 and the rearmost columns 20 (20*a*)). By providing the engaging walls 21, both the end portions of the cargo C placed within the shipping container can be supported in the lateral direction (particularly if the cargo C consists of long objects). Thus, the engaging walls 21 make the cargo C less likely to be inclined diagonally within the shipping container, thus preventing the load of the cargo C from being applied only to a particular one or ones of the columns 20. The widths (lengths in the fore and aft direction) of the engaging walls 21 are not limited, but are preferably from 30 to 80 cm.

While in the embodiment, the columns 20 (20*a*) at the foremost portion, central portion, and the rearmost portion of the shipping container are in the shape of a ladder, this is merely one example. That is, any one or ones of the 14 columns 20 may have the shape of a ladder, taking into consideration, for example, the convenience of checking how the cargo C is loaded in the shipping container. Alternatively, none of the columns 20 may have the shape of a ladder.

The top plates 30 cover the upper portion of the shipping container, and are detachable from the columns 20. The top plates 30 are two separate top plate members 30*a* and 30*b* each half the size of the bottom plate 10 ((10 feet or 20 feet long, and 8 feet wide). While two top plates 30, i.e., two separate top plate members 30*a* and 30*b*, are used in this embodiment, a single integral top plate 30 may be used instead, if, for example, the shipping container has a short total length (e.g., 20 feet).

Figure 3:
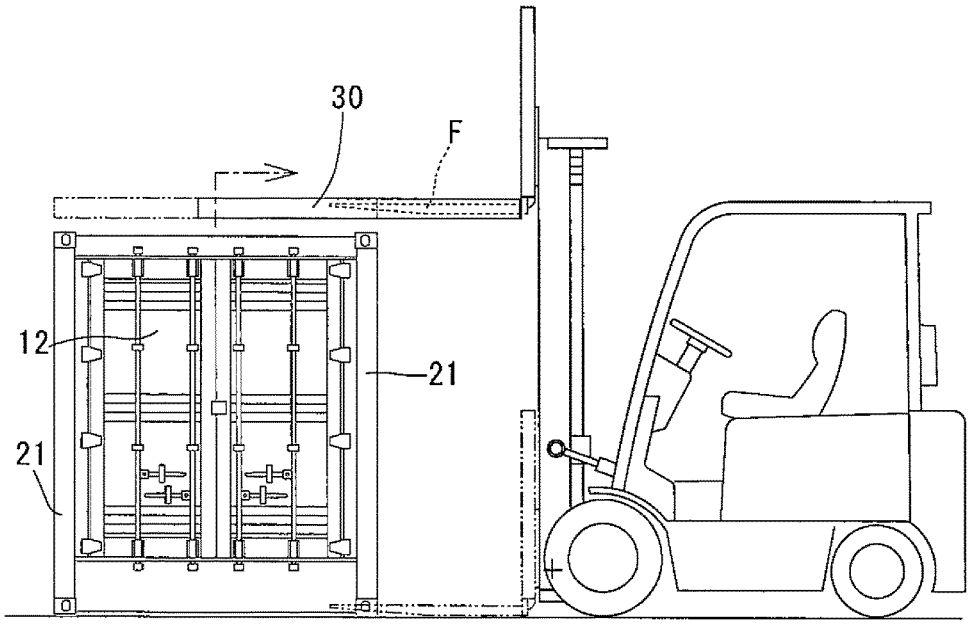
FIG. 3 is a front view of the shipping container of FIG. 1, illustrating an operation for removing the top plates.

A pair of insertion recesses 31 are formed in each of the top plates 30 (separate top plate members 30*a* and 30*b*) to extend from side to side thereof. The interval between the pair of insertion recesses 31 is equal to the interval between the pair of forks F of the forklift shown in FIG. 3 so that the forks F of the forklift can be inserted into the insertion recesses 31 of each top plate 30 forks F can be elevated and lowered, thereby allowing for easily attaching and detaching the top plate 30 (separate top plate member 30*a*, 30*b*) to and from the columns 20.

The top plates 30 (separate top plate members 30*a* and 30*b*) have, in the lower surfaces thereof, fitting recesses 32 at positions corresponding to the positions of the respective columns 20. The fitting recesses 32 are arranged and configured such that the upper ends of the columns 20 are fitted into the respective fitting recesses 32 (see FIG. 2). By fitting the upper ends of the respective columns 20 into the fitting recesses 32, it is possible, when the cargo C loaded within the shipping container leans against the columns 20, to prevent the columns 20 from significantly bending outwardly due to the load of the cargo C.

Figure 4:
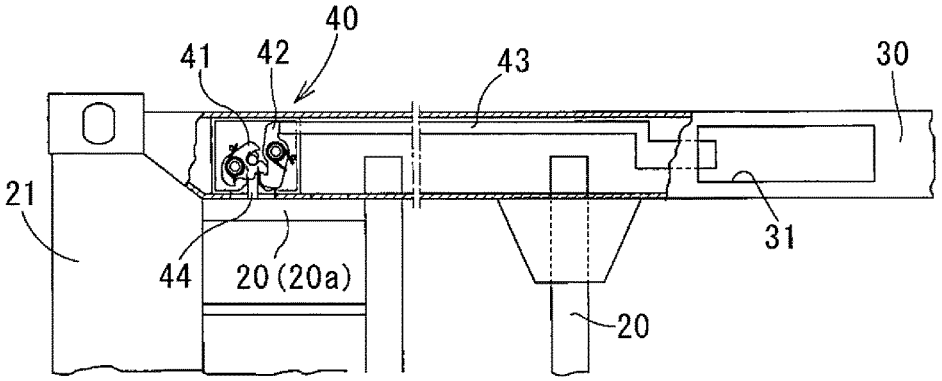
FIGS. 4(*a*) and 4(*b*) are partial sectional views of the shipping container shown in FIG. 1, showing its locking mechanism, seen from the side: of which FIG. 4 (*a*) shows a locked state of the locking mechanism.
Figure 4:
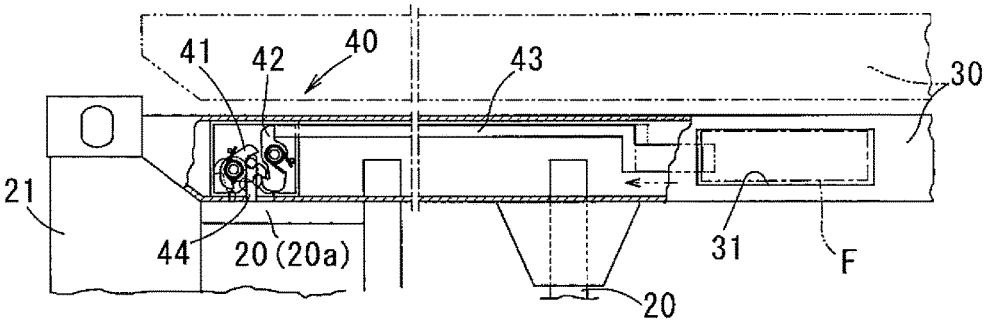

Further, as shown in FIG. 4, a locking mechanism 40 is provided at least at one corner of each top plate 30 (separate top plate member 30*a*, 30*b*). The locking mechanism 40 is configured such that when the top plate 30 is placed on the corresponding columns 20, and the top plate 30 is lowered and fitted to the columns 20 under its own weight, the locking mechanism 40 automatically locks the top plate 30 to the columns 20. The locking mechanism 40 is further configured to automatically unlock the top plate 30 from the columns 20 when the forks F of a forklift are inserted into the insertion recesses 31 formed in the top plate 30.

Figure 5:
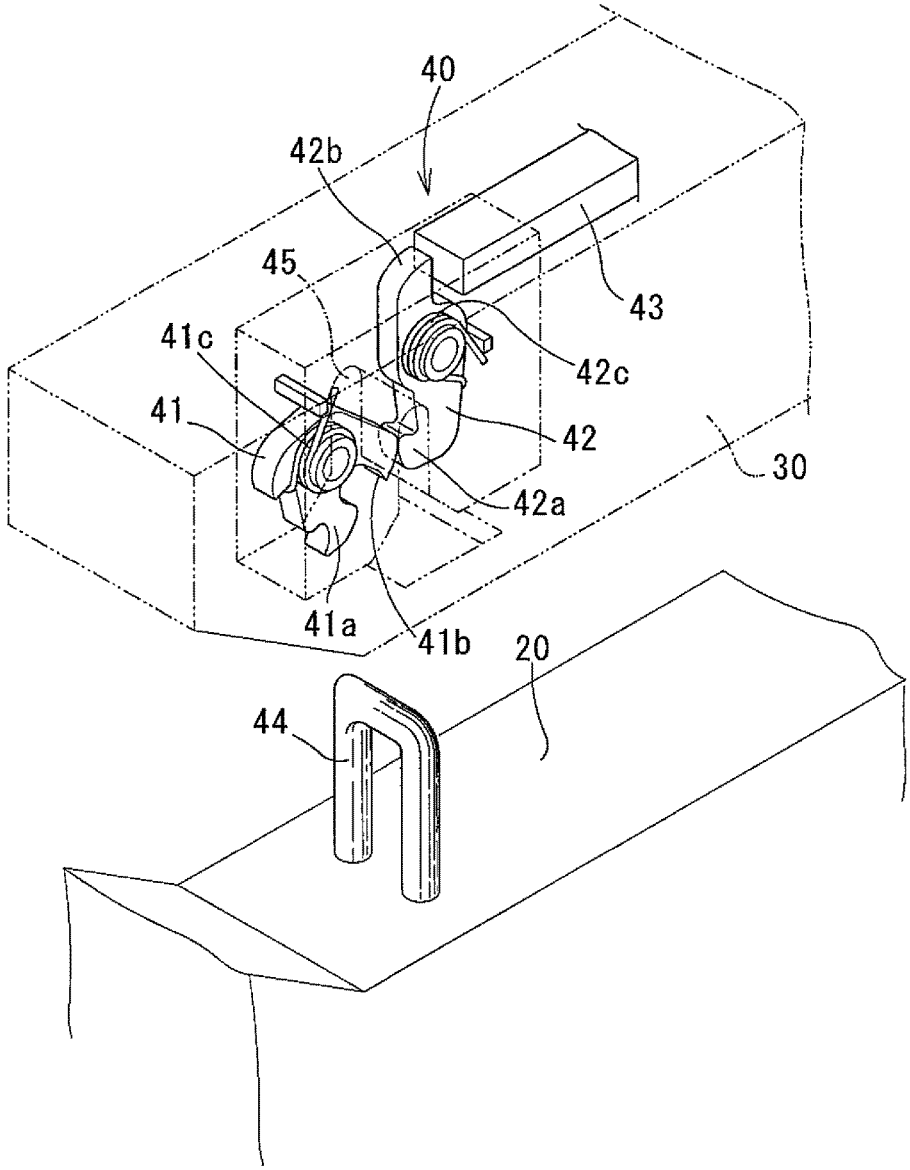
FIG. 5 is a perspective view of the locking mechanism.

As shown in detail in FIG. 5, each locking mechanism 40 mainly includes: a first hook 41, a second hook 42, and an unlocking bar 43 all provided on the top plate 30; and an engaging piece 44 provided on one of the columns 20. The first hook 41 is provided with a first engaging protrusion 41*a* and an engaging recess 41*b*, and is biased in a first direction by a first biasing member 41*c*. The second hook 42 is provided with a second engaging protrusion 42*a* and an abutment portion 42*b*, and is biased by a second biasing member 42*c* in the first direction described above. The above described first direction is the clockwise direction in the figures, and the direction opposite to the above described first direction (i.e., a second direction) is the counterclockwise direction in the figures. The unlocking bar 43 extends into one of the insertion recesses 31 of the top plate 30, while being in abutment with the abutment portion 42*b* of the second hook 42, and is configured to be movable in the lateral direction (i.e., along the longitudinal axis of the top plate 30).

Figure 6:
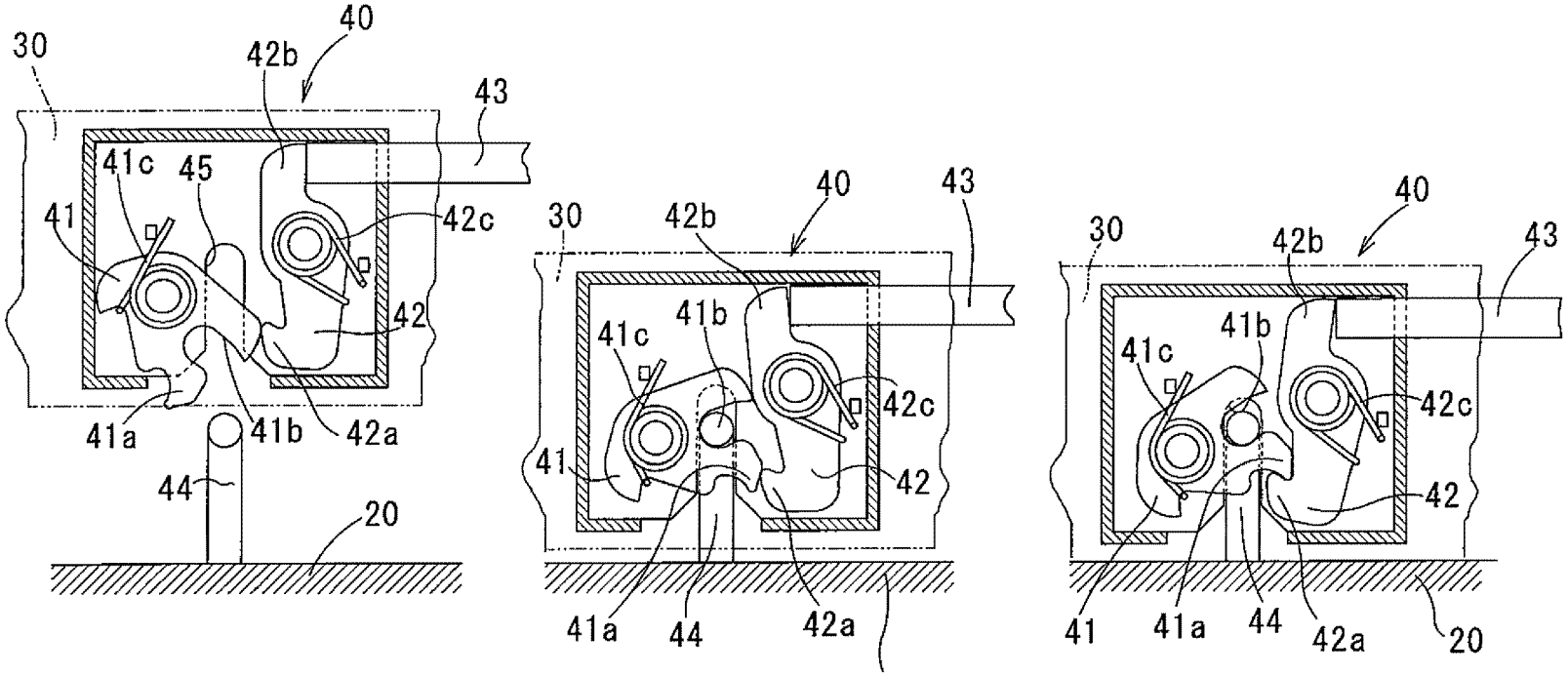
FIGS. 6(*a*)-6(*c*) are vertical sectional views of the locking mechanism: of which FIG. 6 (*a*) shows a state in which a column and the top plate are spaced apart from each other.

As shown in FIGS. 6(*a*) through 6(*c*), when the top plate 30 is lowered toward the columns 20, the engaging piece 44 is inserted into a slit portion 45 of the locking mechanism 40, and comes into contact with the inner surface of the engaging recess 41*b*. This causes the first hook 41 to be rotated in the counterclockwise (second) direction against the biasing force of the first biasing member 41*c* (see FIGS. 6 (*a*) and (*b*)). When the engaging piece 44 is further inserted to a predetermined position, the second hook 42 is rotated in the clockwise (first or locking) direction under the biasing force of the second biasing member 42*c*, thereby allowing the first engaging protrusion 41*a* of the first hook 41 and the second engaging protrusion 42*a* of the second hook 42 to be engaged with each other while holding the engaging piece 44 of the column 20. In this manner, the top plate 30 is locked to the corresponding column 20 (see FIG. 6 (*c*)).

In this state, i.e., with the top plate 30 locked to the column 20, when the forks F of a forklift are inserted into the insertion recesses 31 formed in the top plate 30, the unlocking bar 43 is moved toward the second hook 42 by the fork F inserted in the one of the insertion recesses 31, and the thus moved unlocking bar 43 pushes the abutment portion 42*b* of the second hook 42 in the counterclockwise (second) direction. This causes the second hook 42 to rotate in the counterclockwise (second) direction against the biasing force of the second biasing member 42*c*, and the engagement between the first engaging protrusion 41*a* of the first hook 41 and the second engaging protrusion 42*a* of the second hook 42 is released. In this manner, the top plate 30 is unlocked from the corresponding column 20 (see FIGS. 6 (*c*) to 6(*b*)). When the top plate 30 is moved upward after being unlocked from the columns 20, the first hook 41 is rotated in the clockwise (first) direction under the biasing force of the first biasing member 41*c*, and the engaging piece 44 disengages (is released) from the first hook 41 (see FIG. 6 (*a*)).

The configuration of the locking mechanisms 40 described above is merely an example, and it is also acceptable to provide other types of locking mechanisms, or to provide no locking mechanism at all.

Figure 7:
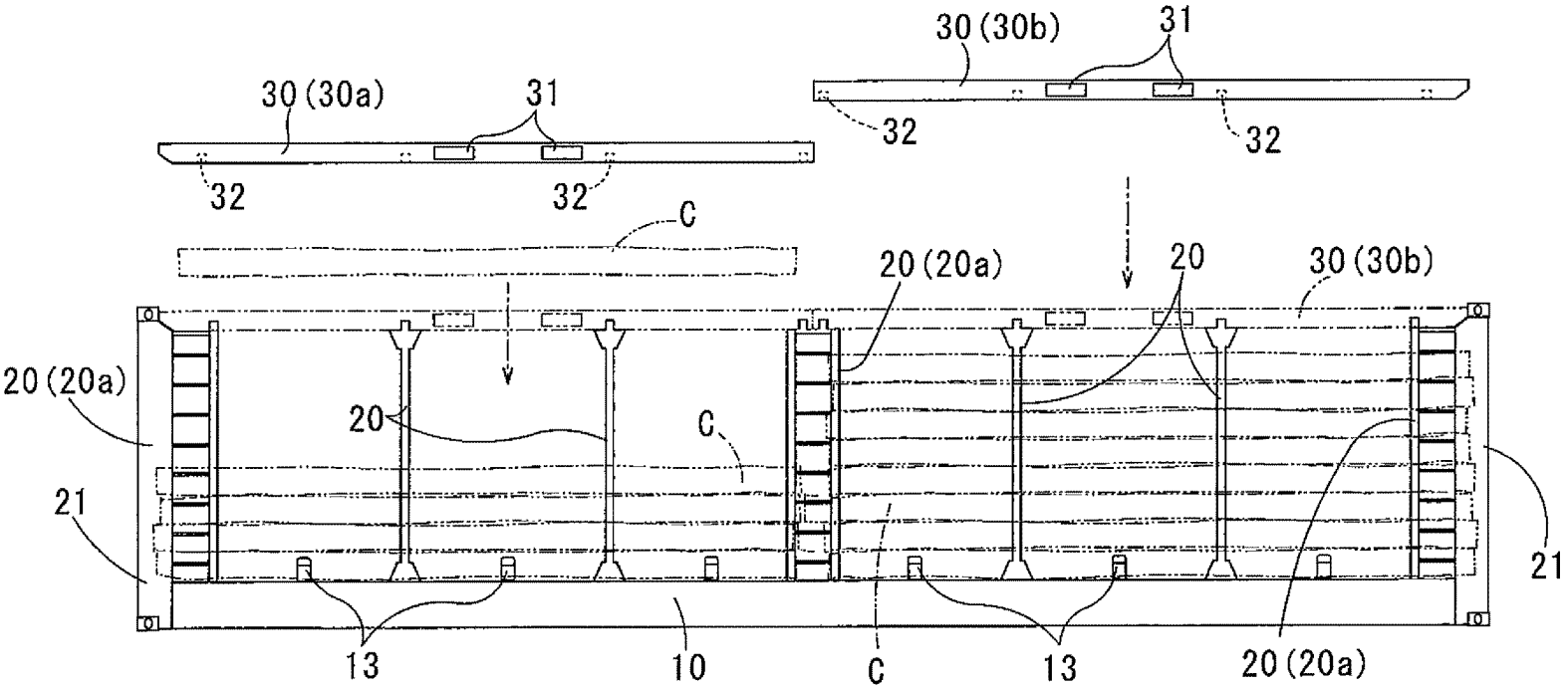
FIG. 7 is a side view of the shipping container of FIG. 1, illustrating the process of loading of long objects into the shipping container.

By removing the top plates 30, it is possible, as shown in FIG. 7, to easily load long objects such as lumber and the like into the shipping container, from above the container, using heavy equipment (not shown) such as a crane, or a forklift, thereby ensuring high operational efficiency. Further, since this shipping container can be stacked on other shipping containers in a container ship in the same manner as ordinary shipping containers, it is not necessary to unload the cargo which has been transported to the harbor by a truck, and reload it into a shipping container. This significantly reduces the steps and cost for loading cargo.

Figure 8:
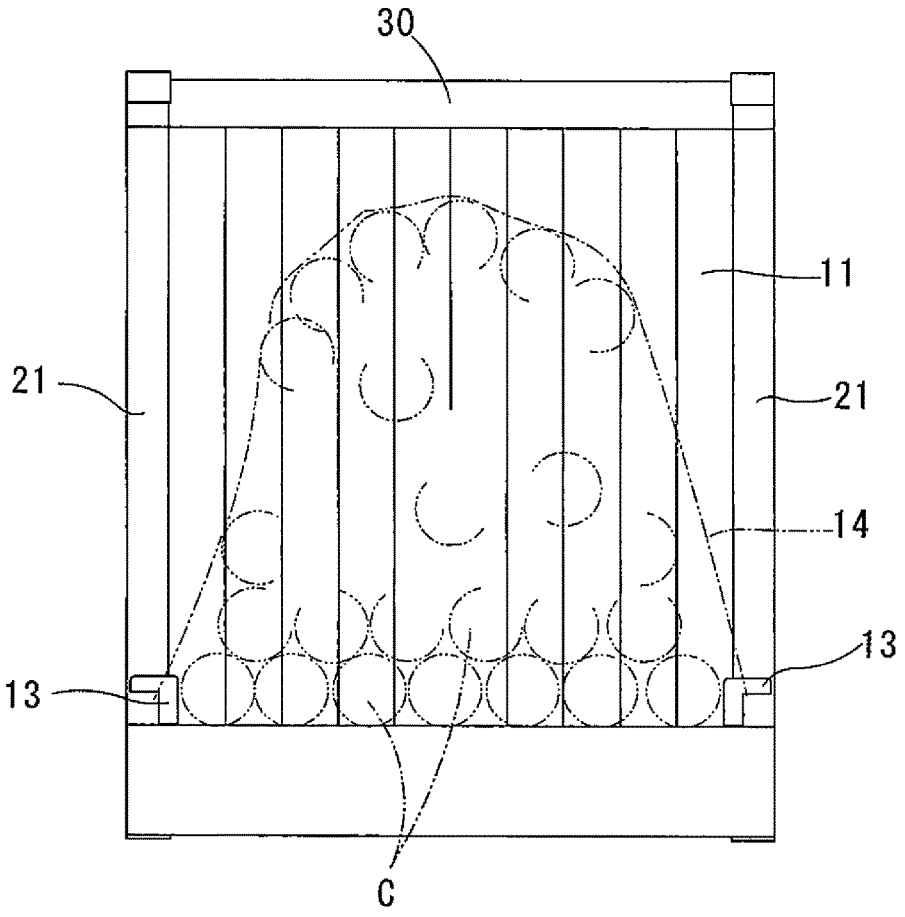
FIG. 8 is a front view of the shipping container showing a state in which the long objects are fixed in position by wires.

If the cargo C is long objects, wires 14 may be wrapped around the cargo C and hooked to the fixing jigs 13 on the right and left sides of the bottom plate to fix the cargo C, as shown in FIG. 8, so that the shifting of the cargo C during transportation can be prevented to enhance safety.

When importing and exporting raw wood, it is required that the raw wood be subjected to a disinfection treatment by fumigation, and be loaded into a ship, and the like, within a specified period of time (two weeks, for example) after the disinfection treatment. The fumigation treatment is carried out by: stacking the raw wood in a pile at a predetermined location; covering a sheet over the stacked raw wood, and sealing the circumference of the sheet; and then filling the sealed space enclosed by the sheet with gas for fumigation. If the raw wood has been transported in a shipping container or the like, the raw wood needs to be unloaded for the fumigation treatment. The reason for this is as follows. A common shipping container has corrugated side plates, and thus it is difficult to allow the gas for fumigation to fully spread within the interior of the shipping container. In addition, the extent to which the gas is spread and filled within the shipping container cannot be confirmed, making it difficult to stably carry out the fumigation operation. As described above, the necessity to unload the cargo significantly complicates the series of shipping operations, and makes it time-consuming as well as cost-consuming.

In contrast, when the shipping container according to the present invention is used, this fumigation operation can be carried out extremely smoothly and securely. In other words, although this shipping container does not have side plates, it is possible to easily seal the interior of the shipping container, by placing a sheet over the top plates 30 and covering the sides of the shipping container. In addition, by covering the shipping container by a sheet, it is possible to easily confirm the extent to which the gas for fumigation is spread and filled within the shipping container, and thus to adjust the amount of the gas to be introduced into the shipping container so that a uniform fumigation treatment can be performed. Further, if at least one of the columns 20 is in the shape of a ladder, an operator can climb up the ladder-shaped column 20 to the top of the shipping container, to smoothly carry out an operation for covering the shipping container with a sheet.

The above-described embodiment is merely an example, and the shape, the arrangement, the number and the like of the component members of the shipping container, such as the bottom plate 10, the columns 20, and the top plates 30 can be changed as appropriate, as long as it is possible to realize the object of the present invention, which is to provide a shipping container into which long objects such as lumber can be efficiently loaded.

DESCRIPTION OF SYMBOLS

10 bottom plate
11 front plate
12 openable and closable doors
13 fixing jig
14 wire
20 (20*a*) column
21 engaging wall
30 top plate
30*a*, 30*b* divided top plate portion
31 insertion recess
32 fitting recess
40 locking mechanism
41 first hook
41*a* first engaging protrusion
41*b* engaging recess
41*c* first biasing member

42 second hook
42*a* second engaging protrusion
42*b* abutment portion
42*c* second biasing member
43 unlocking bar
44 engaging piece
45 slit portion
C cargo
F forks

The invention claimed is:

1. A shipping container comprising:

a bottom plate onto which cargo is to be placed, the bottom plate having a first side and a second side opposite from the first side;

first columns vertically extending from the first side of the bottom plate such that each adjacent pair of the first columns defines a space therebetween through which cargo in the shipping container can be seen from outside the shipping container;

second columns vertically extending from the second side of the bottom plate such that each adjacent pair of the second columns defines a space therebetween through which cargo in the shipping container can be seen from outside the shipping container; and a top plate detachably supported by the first columns and the second columns, the top plate having an insertion recess, wherein the shipping container is configured free of side plates such that, with the top plate removed from the shipping container, cargo can be loaded into the shipping container from above the shipping container and through at least one of the first side and the second side utilizing at least one of the spaces between adjacent columns, and such that cargo in the shipping container can lean against any of the first and second columns, and a locking mechanism configured to automatically lock and connect the top plate to the columns when the top plate is placed on the columns so as to prevent horizontal and vertical movement of the top plate relative to the columns while the locking mechanism is in a locked position, and to unlock and release the top plate from the columns when a jig is inserted into the insertion recess of the top plate.

2. The shipping container according to claim 1, wherein the locking mechanism includes a hook mounted within the top plate, and an engagement piece mounted to at least one of the columns, the hook being configured to engage and latch onto the engagement piece when the top plate is placed on the columns.

3. The shipping container according to claim 2, wherein one of the columns is in the shape of a ladder.

4. The shipping container according to claim 2, wherein the locking mechanism further includes an unlocking bar extending between the insertion recess and the hook, and a biasing member for biasing the hook in a locking direction, the unlocking bar being configured to slide and push the hook in a direction opposite the locking direction when the jig is inserted into the insertion recess so as to release the engagement piece.

5. The shipping container according to claim 4, wherein the hook is a second hook and the biasing member is a second biasing member, the locking mechanism further including a first hook having an engaging recess for engaging the engaging piece, and a first biasing member for biasing the first hook in the locking direction, the first hook having a first engaging protrusion for engaging a second engaging protrusion of the second hook when the locking mechanism is in a locking position.

6. The shipping container according to claim 2, wherein the engaging piece is a U-shaped bar.

7. The shipping container according to claim 1, wherein one of the columns is in the shape of a ladder.

8. The shipping container according to claim 1, wherein the top plate has fitting recesses for releasably receiving an upper end of the columns.

* * * * *